US008298012B2

(12) United States Patent
Csak

(10) Patent No.: US 8,298,012 B2
(45) Date of Patent: Oct. 30, 2012

(54) ELECTRICAL CONNECTOR HAVING A SPIN RING AND A PRE-MOLD WITH A WIGGLE RING GROOVE

(75) Inventor: Louis R. Csak, Old Greenwich, CT (US)

(73) Assignee: Lex Products Corporation, Shelton, CT (US)

( * ) Notice: Subject to any disclaimer, the term of this patent is extended or adjusted under 35 U.S.C. 154(b) by 0 days.

(21) Appl. No.: 13/419,589

(22) Filed: Mar. 14, 2012

(65) Prior Publication Data

US 2012/0171896 A1 Jul. 5, 2012

Related U.S. Application Data

(63) Continuation of application No. 12/979,961, filed on Dec. 28, 2010, now Pat. No. 8,152,563.

(51) Int. Cl.
*H01R 13/58* (2006.01)

(52) U.S. Cl. ..... 439/606

(58) Field of Classification Search ..... 439/606, 439/587–589

See application file for complete search history.

(56) References Cited

U.S. PATENT DOCUMENTS

| | | | | |
|---|---|---|---|---|
| 2,544,430 | A | 3/1951 | McCutchan | |
| 2,949,642 | A * | 8/1960 | Lieberman | 264/274 |
| 3,784,729 | A | 1/1974 | Davis et al. | |
| 3,816,641 | A * | 6/1974 | Iversen | 174/76 |
| 4,025,600 | A | 5/1977 | Parr | |
| 4,090,294 | A | 5/1978 | Parr | |
| 4,495,130 | A | 1/1985 | Hedrick | |
| 5,470,238 | A | 11/1995 | Walden | |
| 5,593,320 | A * | 1/1997 | Konda et al. | 439/589 |
| 6,131,270 | A | 10/2000 | Van Den Berg | |
| 6,361,342 | B1 * | 3/2002 | Cox | 439/275 |
| 6,648,686 | B2 * | 11/2003 | Nishimoto | 439/606 |
| 6,679,730 | B2 * | 1/2004 | Dye et al. | 439/606 |
| 6,695,641 | B1 | 2/2004 | Lee | |
| 6,793,530 | B2 | 9/2004 | Waise | |
| 7,201,595 | B1 * | 4/2007 | Morello | 439/271 |
| 8,152,563 | B1 * | 4/2012 | Csak | 439/606 |
| 2003/0129875 | A1 | 7/2003 | Ho | |
| 2006/0246779 | A1 | 11/2006 | Helbok et al. | |
| 2009/0004916 | A1 | 1/2009 | Miyoshi et al. | |
| 2009/0042435 | A1 | 2/2009 | Ute et al. | |

* cited by examiner

*Primary Examiner* — Chandrika Prasad
(74) *Attorney, Agent, or Firm* — Steven M. McHugh

(57) ABSTRACT

An electrical connector is provided wherein the electrical connector includes an electrical connector neck which separates an electrical connector rear from an electrical connector front and wherein the electrical connector rear includes an electrical connector termination. The electrical connector includes a pre-mold material having an over-mold groove and a wiggle ring groove, wherein the pre-mold material is securely associated with the electrical connector to cover the electrical connector rear and the electrical connector termination. Additionally, an over-mold material is securely associated with the electrical connector to cover a portion of the pre-mold material, wherein a portion of the over-mold material is located in the over-mold groove.

17 Claims, 18 Drawing Sheets

ELECTRICAL CONNECTOR HAVING A SPIN RING AND A PRE-MOLD WITH A WIGGLE RING GROOVE

RELATED APPLICATIONS

This application is a continuation patent application of, and claims benefit from, U.S. patent application Ser. No. 12/979,961, filed Dec. 28, 2010 now U.S. Pat. No. 8,152,563, the contents of which are incorporated by reference herein in its entirety.

FIELD OF THE INVENTION

The present invention relates to molded electrical connectors that have a spin ring and more particularly to an improved method for making an electrical connector where the connector has a reinforced spin ring.

BACKGROUND OF THE INVENTION

Electrical connector assemblies which include a multi-pin connector connected to the end of a multi-cable assembly and which are configured to connect with electrical equipment or the end of a matched type multi-cable connector assembly are well known in the art. These connectors assemblies, which may have male-type electrical pin connectors to connect with a female-type socket interface (and/or alternatively female-type sockets to receive a male-type electrical pin interface), are typically used for electrical supply lines or to connect a device to a control bus or central power supply and are used extensively in various applications across several different industries, such as the entertainment industry for distributing power to instruments, lighting fixtures and other equipment. These types of cable/connector assemblies are preferred for the foregoing tasks as they are safe, somewhat durable, reliable, and maintenance free.

Referring to FIG. 1*a* and FIG. 1*b*, a typical electrical connector assembly 100 is shown and includes a plurality of cables 102 (which may be partially or wholly covered in a protective rubber material 103) and a multi-pin connector 104 having a connector housing 106 which includes a plurality of pins 108 (or sockets 109 as shown in FIG. 1*b*) that are accessible from a front side 110 of the connector housing 106, where each of the pins 108 is mechanically (and electrically) connected to one or more of a plurality of pin (or socket) terminations 112 that are accessible from the rear side 114 of the connector housing 106 (a female-male type connector pair is shown in FIG. 1*c*). Referring to FIG. 1*b*, each of the conductors of the plurality of cables 102 is mechanically (and electrically) connected to one or more of the plurality of pin terminations 112. A metal sleeve is connected to the back end of the connector and fixed to the cable via a clamping device.

Unfortunately however, current electrical connector assemblies 100 have several disadvantages. First, the typical electrical connector assembly 100 is bulky, heavy, subject to rust and scratching and they have several machined components that are very costly to produce. Second, because the clamping device doesn't completely encase the cables and metal sleeve, the assembly allows for unwanted movement of the cables during use. This causes an increase in the strain on the cables and wiring terminations and decreases the lifespan and reliability of the electrical connector assembly. Third, the metal housing of the connectors is not very 'user friendly' because the metal housing can get very hot or very cold during extreme environmental conditions. If the housing gets too hot, the metal can burn a user and if the housing gets too cold, the metal can freeze a user's skin. Fourth, the connector assemblies have an attachment means that are used to securely connect one connector assembly with another connector assembly for safe operation during use. Unfortunately however, these attachment means are loosely associated with the connector assembly and are allowed to move in an angular and/or side-to-side fashion. Thus, it is desirable to make an improved version of the foregoing kinds of connectors, where the connectors are more attractive and smaller in profile, while at the same time providing a stronger connector assembly having a greater life expectancy and reliability than current connectors.

SUMMARY OF THE INVENTION

An electrical connector assembly is provided and includes a cable having an electrical conductor, an electrical connector having an electrical connector neck which separates an electrical connector rear from an electrical connector front, wherein the electrical connector neck includes an electrical connector neck diameter and the electrical connector rear includes an electrical connector termination connected to the electrical conductor, a pre-mold material having an over-mold groove and a wiggle ring groove, the pre-mold material being securely associated with the electrical connector assembly to cover the electrical connector rear, the electrical connector termination, and a portion of the electrical conductor and the cable. The electrical connector assembly further includes an over-mold material securely associated with the electrical connector assembly to cover a portion of the pre-mold material and the cable, wherein a portion of the over-mold material is located in the over-mold groove.

An electrical connector is provided wherein the electrical connector includes an electrical connector neck which separates an electrical connector rear from an electrical connector front and wherein the electrical connector rear includes an electrical connector termination. The electrical connector includes a pre-mold material having an over-mold groove and a wiggle ring groove, wherein the pre-mold material is securely associated with the electrical connector to cover the electrical connector rear and the electrical connector termination. Additionally, an over-mold material is securely associated with the electrical connector to cover a portion of the pre-mold material, wherein a portion of the over-mold material is located in the over-mold groove.

DETAILED DESCRIPTION OF THE INVENTION

It should be appreciated that although the invention is disclosed herein with regards to a male type electrical connector, the invention may also be used with a female type electrical connector as well.

Figure 1A:
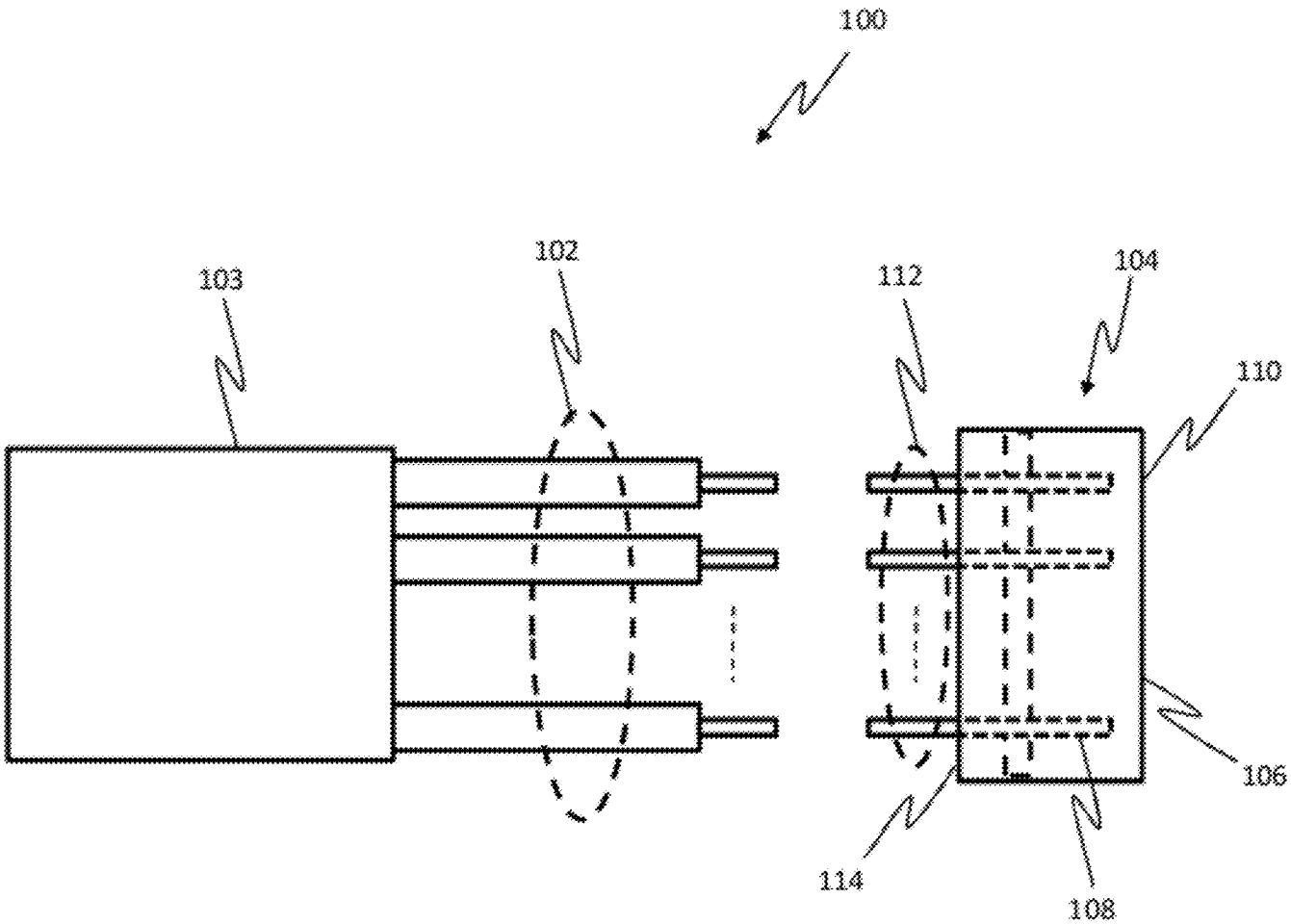
FIG. 1*a* is a schematic side view illustrating a disassembled unmolded electrical connector assembly showing a male type electrical connector and a plurality of cables with conductors.
Figure 1B:
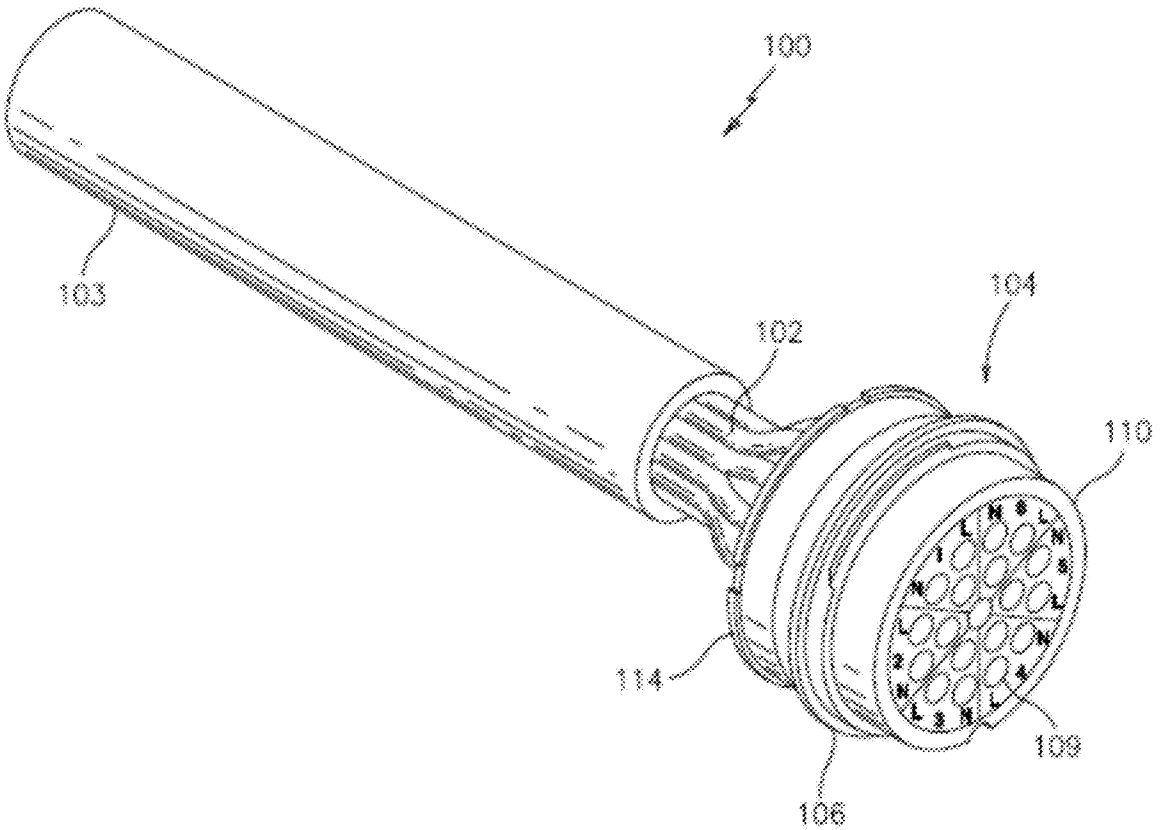
FIG. 1*b* is an isometric view showing an assembled unmolded electrical connector assembly of FIG. 1*a*.
Figure 1C:
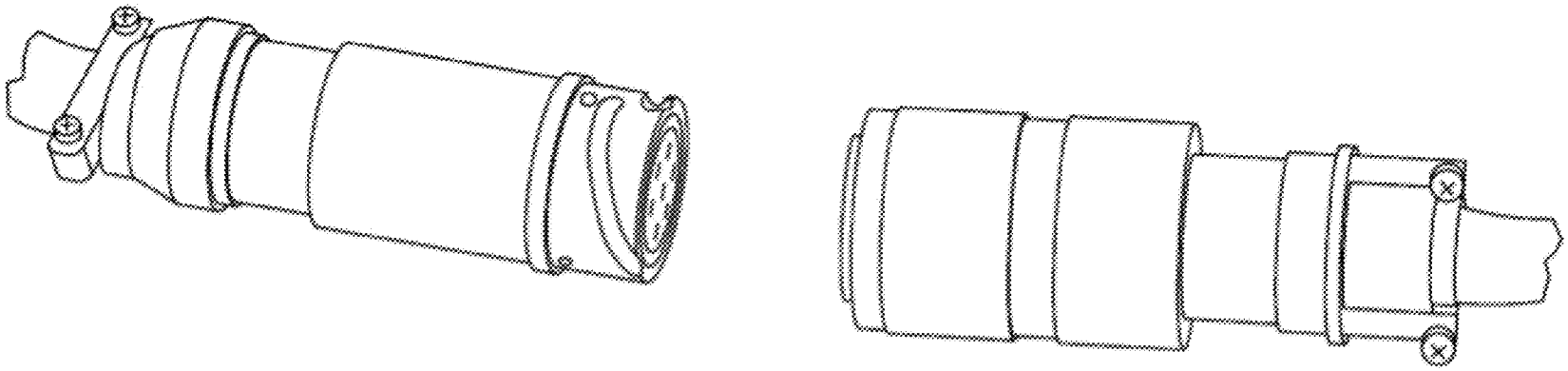
Figure 1c (Prior Art)
FIG. 1*c* is an isometric view showing an electrical connector assembly showing a female type connector and a male type connector, in accordance with the prior art.
Figure 2:
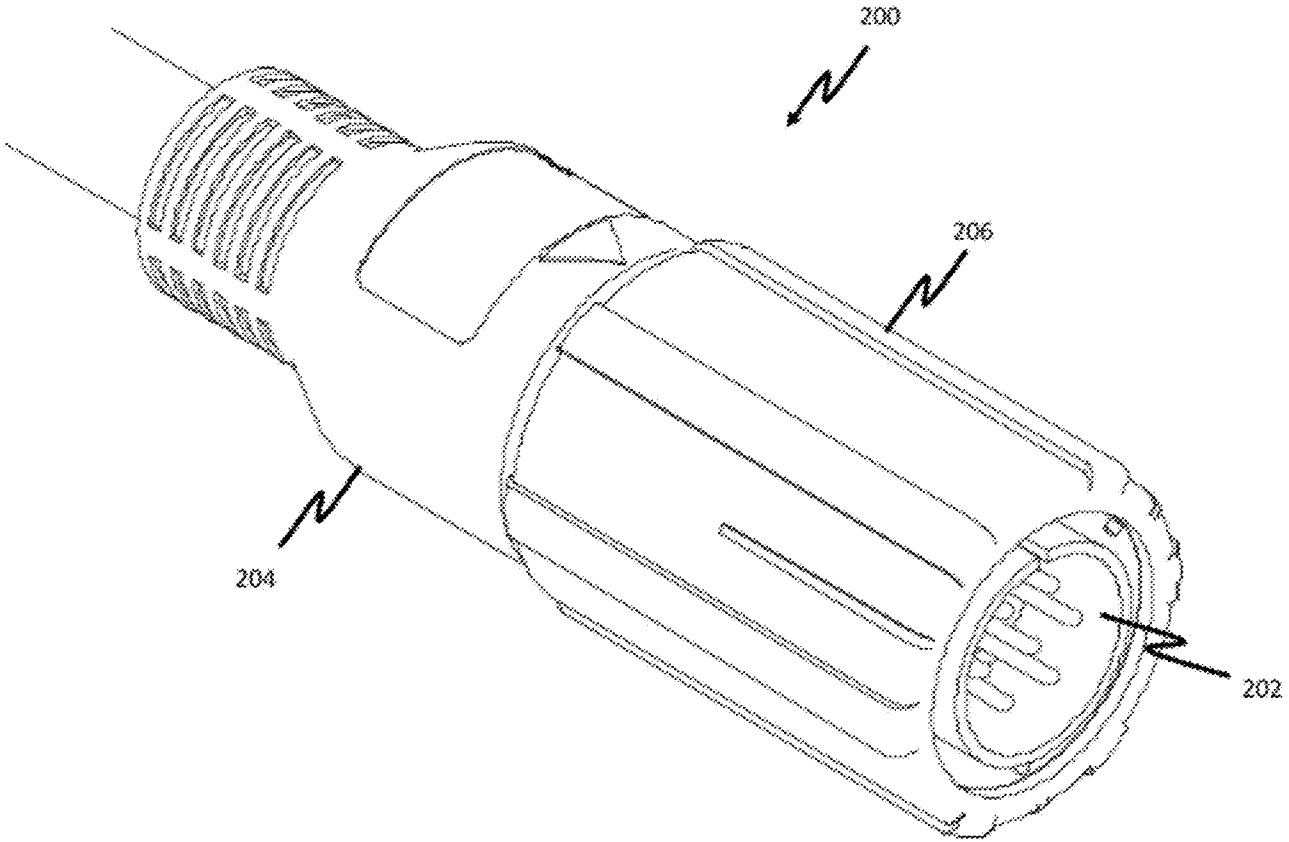
FIG. 2 is an isometric view showing an improved electrical connector assembly, in accordance with the present invention.
Figure 3A:
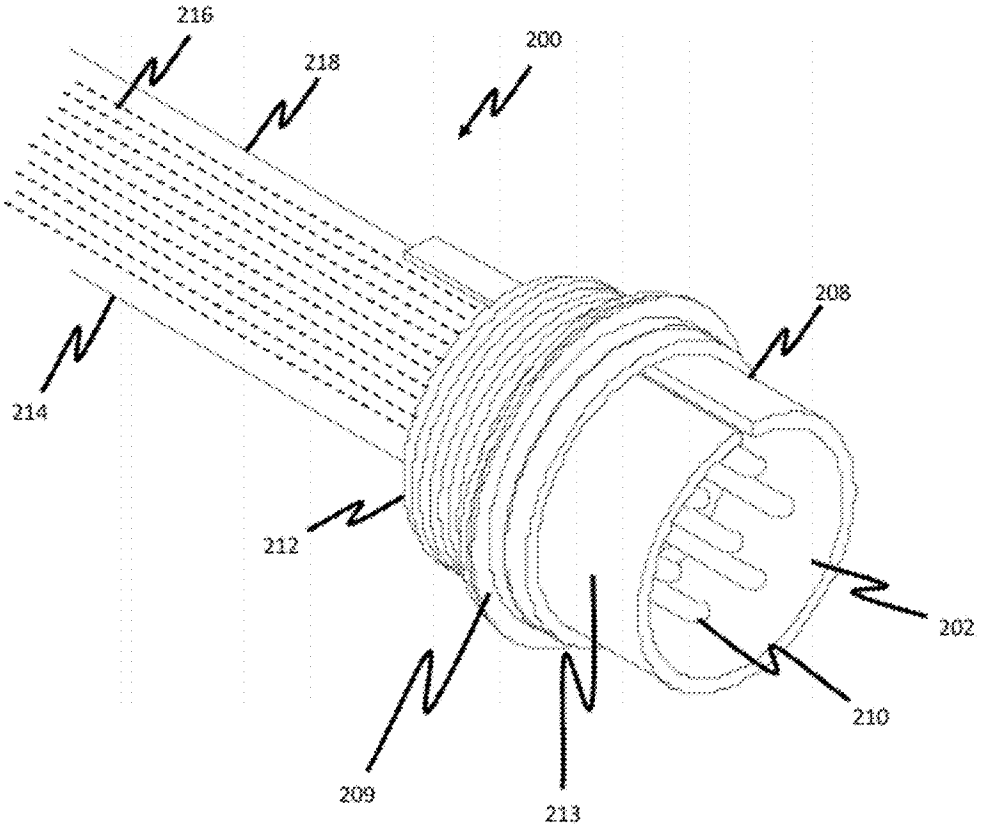
FIG. 3*a* is an isometric view of the improved electrical connector assembly of FIG. 2, prior to the application of pre-mold material.
Figure 3B:
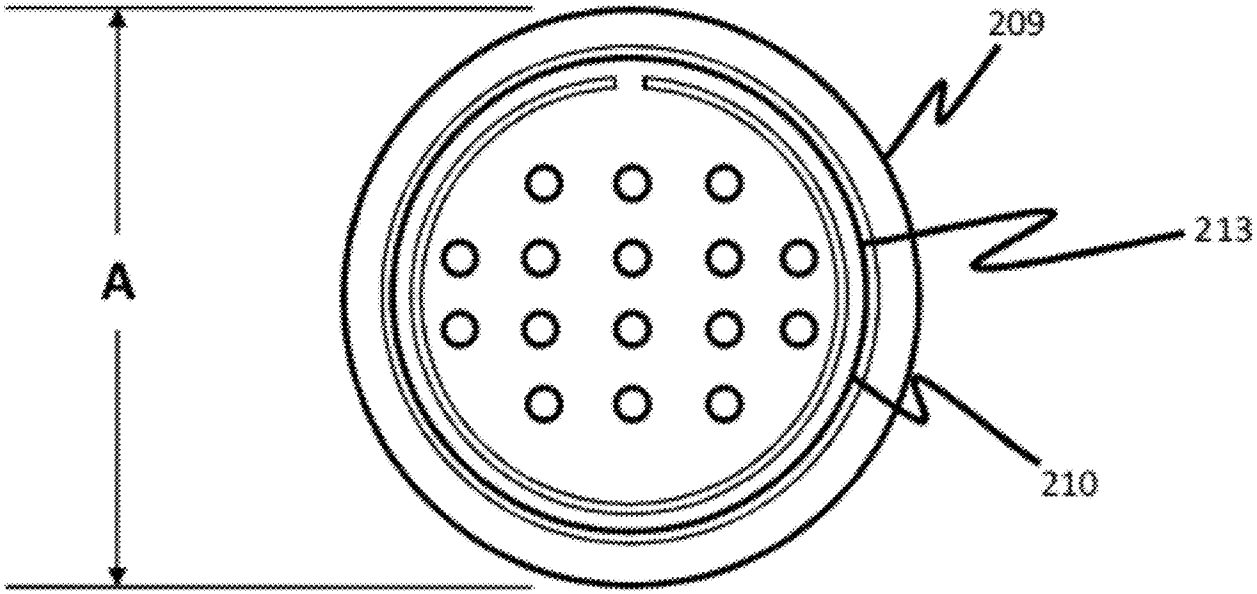
FIG. 3*b* is a front view of the improved electrical connector assembly of FIG. 3*a*.

In accordance with the present invention, an improved electrical connector assembly 200 is discussed hereinafter with reference to the figures. Referring to FIG. 2, an improved electrical connector assembly 200 is shown and includes a male electrical connector or plug 202 (a female electrical connector may be used as well), an over-mold material 204 and a spin ring 206. Referring to FIG. 3*a* and FIG. 3*b*, the electrical connector 202 includes a connector housing 208 having a housing neck 209 with a housing neck diameter A, which separates the rear side 212 of the connector housing 208 from the front side 213 of the connector housing 208. Additionally the connector housing 208 includes a plurality of connector pins 210 (or connector sockets) that are accessible from the front side 213 and rear side 212 of the connector housing 208. It should be appreciated that the housing neck diameter A is larger in diameter than the diameter of the rest of the connector housing 208 such that it protrudes from the connector housing 208 to form a lip. A cable 214 having a plurality of electrical conductors (and/or optical fibers) 216 covered in a protective insulating sheath 218 is provided, where each of the electrical conductors 216 are connected to at least one of the plurality of connector pins 210 at the rear side 212 of the connector housing 208.

Figure 4:
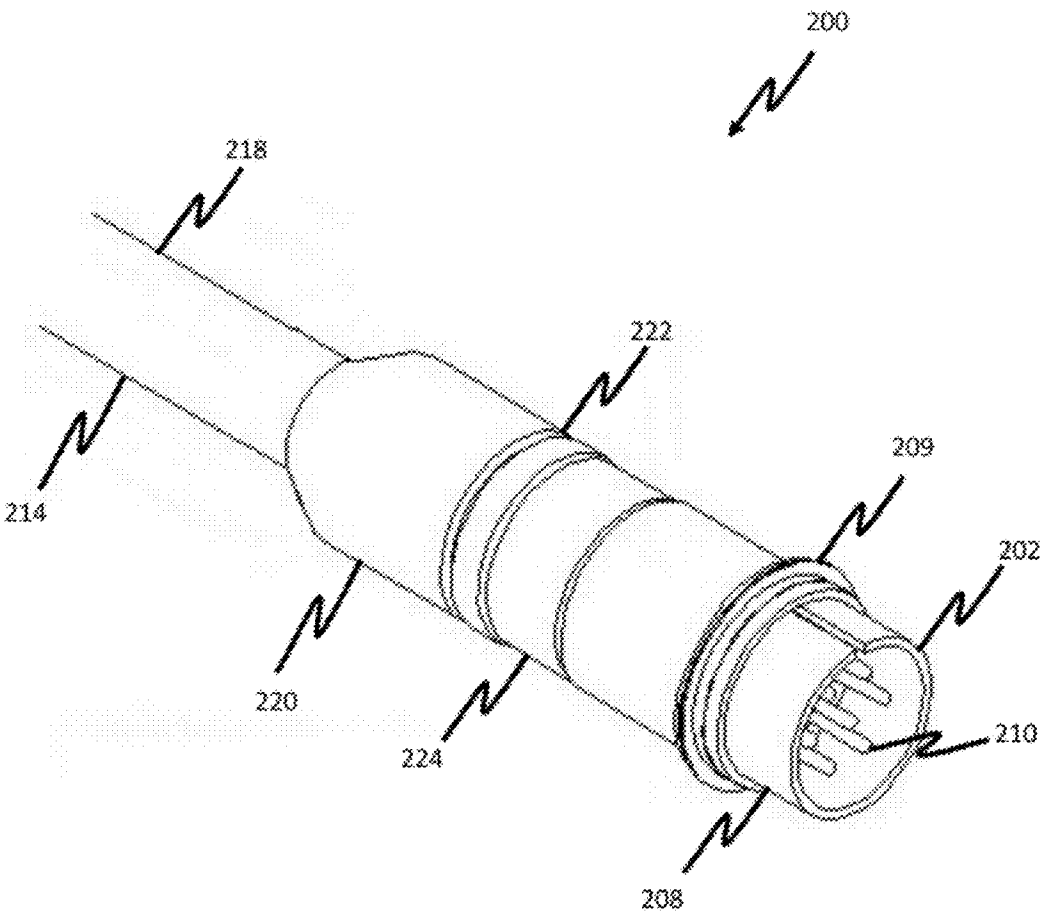
FIG. 4 is an isometric view of the improved electrical connector assembly of FIG. 2, following the application of pre-mold material.
Figure 5A:
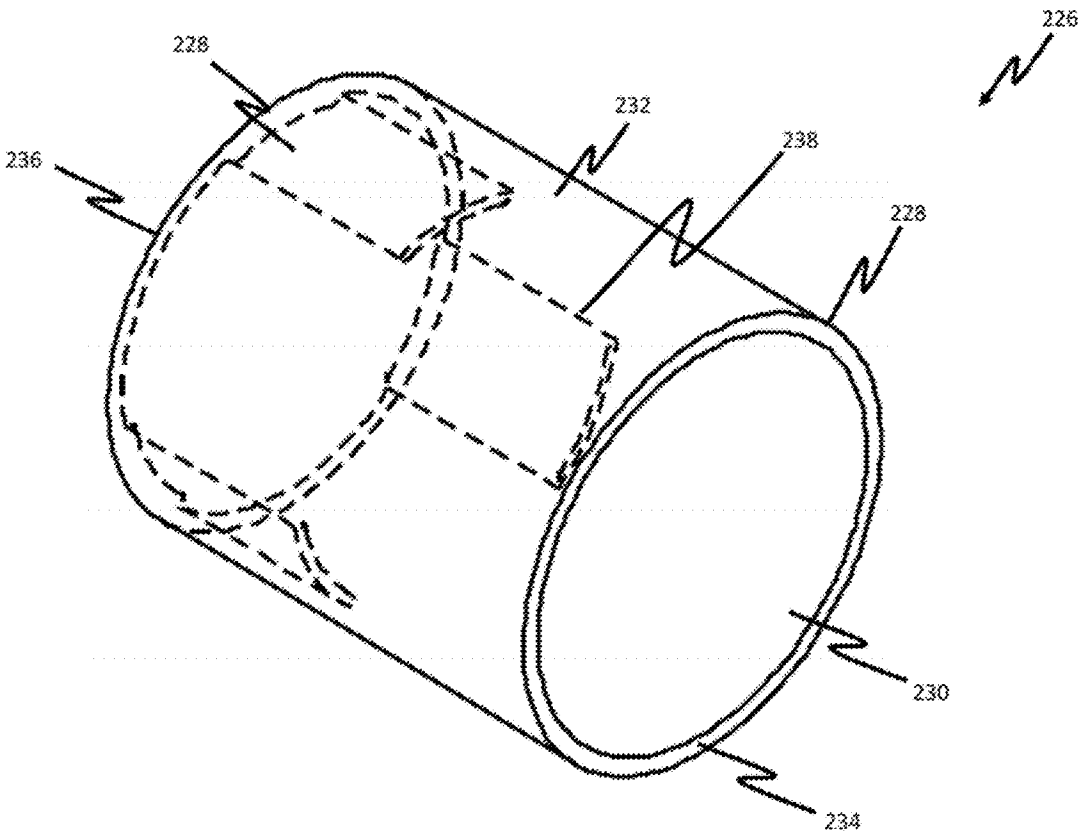
FIG. 5*a* is an isometric view of a wiggle ring for the improved electrical connector assembly of FIG. 2.
Figure 5C:
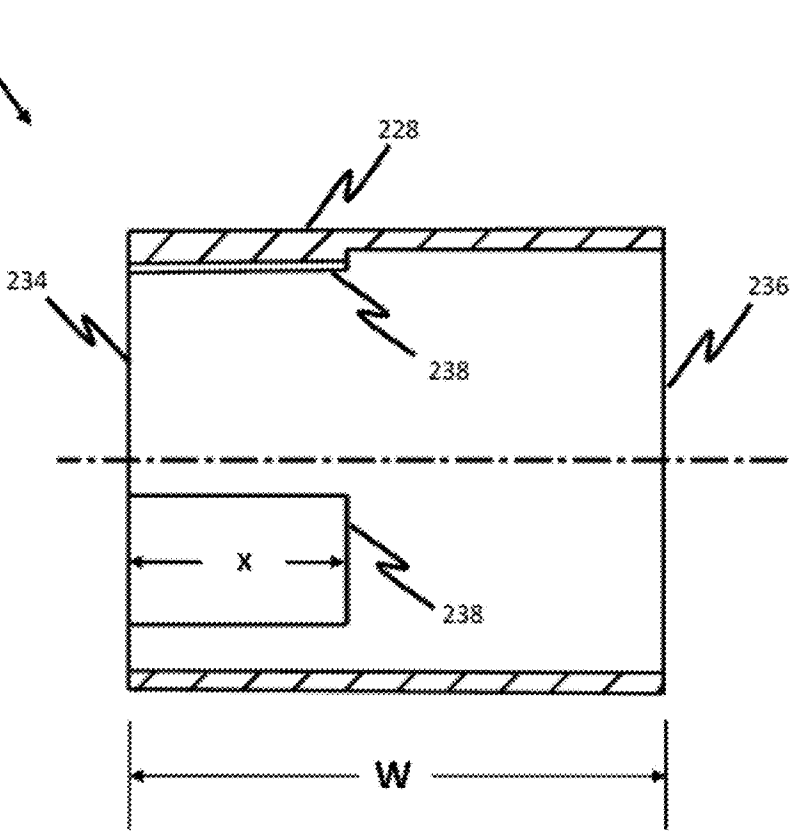
FIG. 5*c* is a side sectional view of the wiggle ring of FIG. 5*a*.
Figure 5B:
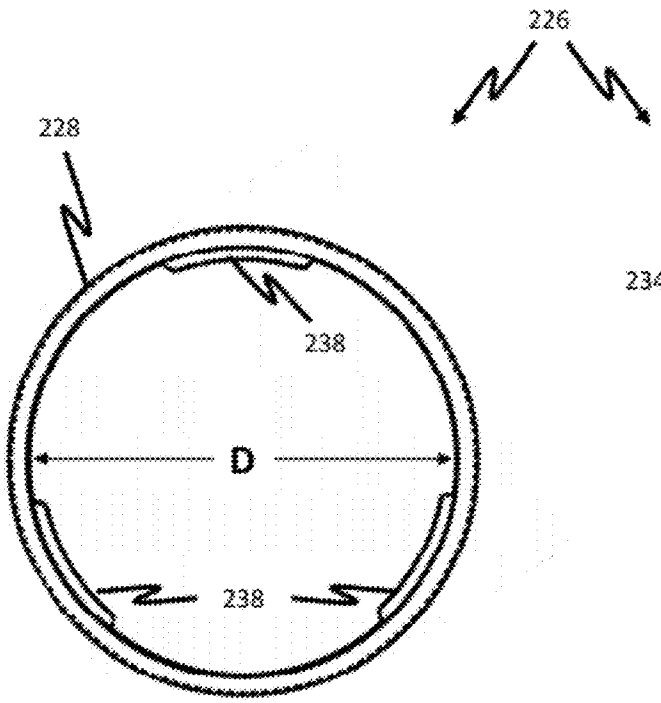
FIG. 5*b* is a front view of the wiggle ring of FIG. 5*a*.
Figure 5D:
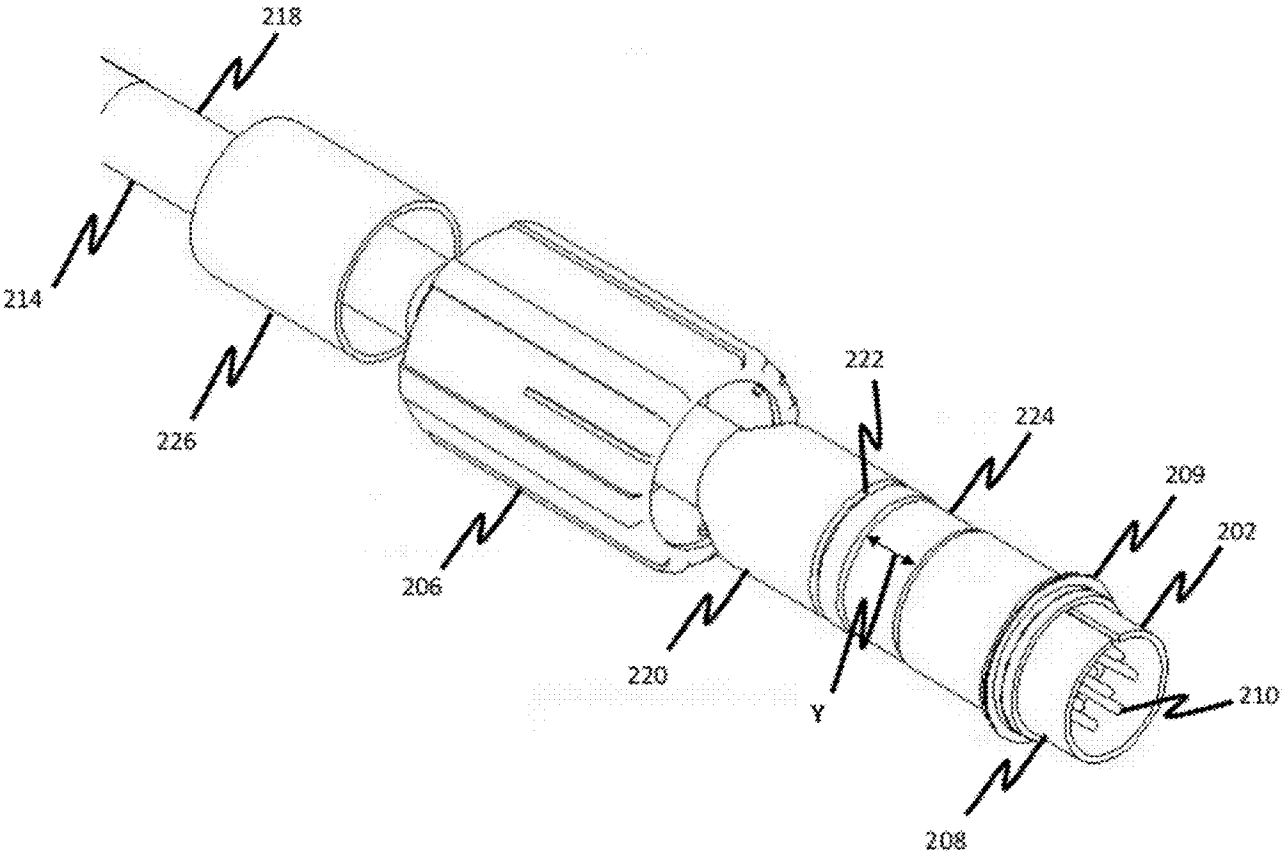
FIG. 5*d* is an isometric view of the improved electrical connector of FIG. 2, prior to the association of the wiggle ring and the spin ring.
Figure 5E:
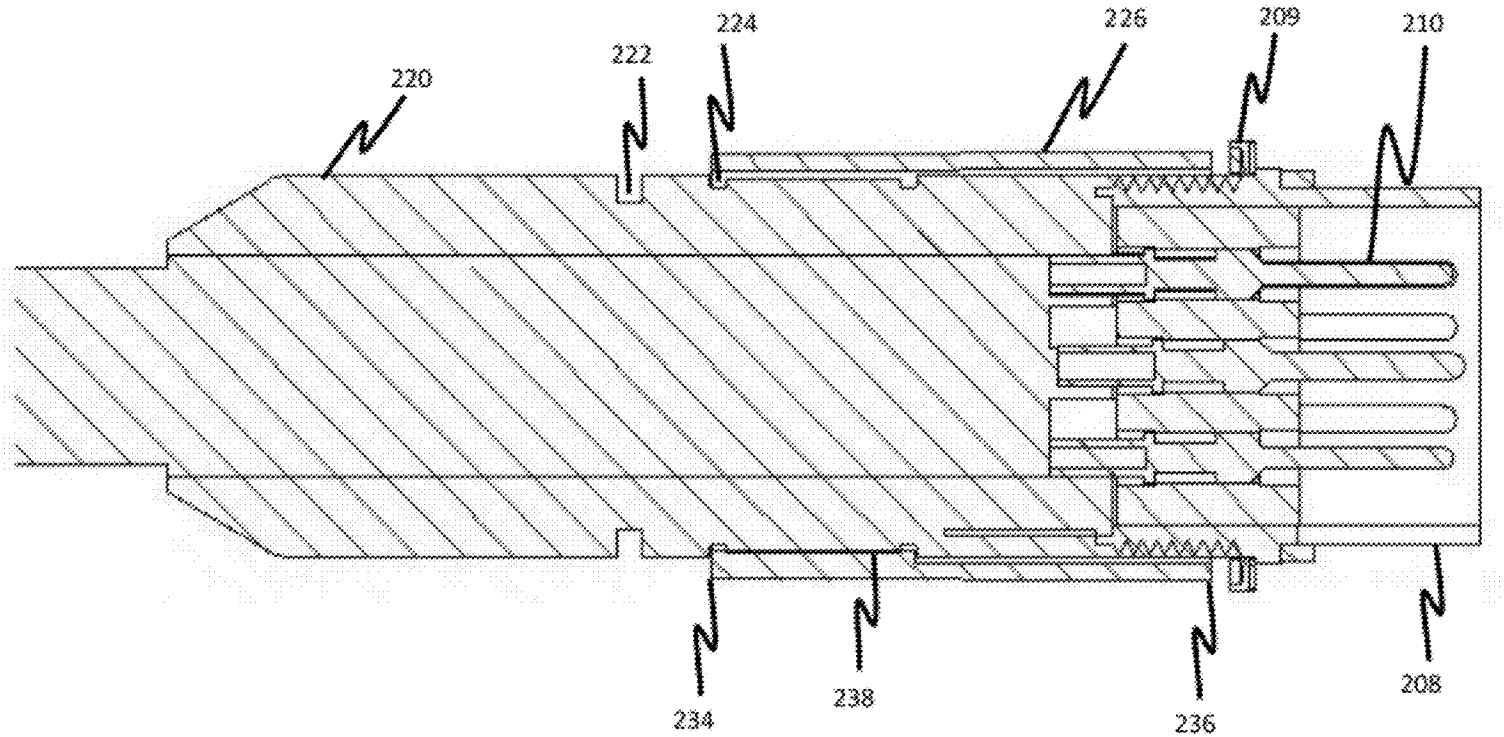
FIG. 5*e* is a side sectional view of the improved electrical connector of FIG. 2, with the wiggle ring associated therewith.

Referring to FIG. 4, a pre-mold material 220 is molded onto the electrical connector assembly 200 such that the connections between the electrical conductors 216 and the connector pins 210, at the rear side 212 of the connector housing 208, are covered by the pre-mold material 220. Additionally, the rear side 212 of the connector housing 208 (up to the housing neck 209) and a portion of the cable 214 (with the sheath 218) may also be covered by the pre-mold material 220. It should be appreciated that the housing neck 209 has a larger diameter than the pre-mold material 220 such that it protrudes from the connector housing 208 forming a lip between the front side 213 and the rear side 212 of the connector housing 208. Furthermore, the pre-mold material 220 includes an over-mold groove 222 and a wiggle ring groove 224 which may be molded into the pre-mold material 220. It is contemplated that the over-mold groove 222 and the wiggle ring groove 224 may extend around the entire circumference of the pre-mold material 220 or may only extend partially around the circumference of the pre-mold material 220. Additionally, although the over-mold groove 222 and the wiggle ring groove 224 are described as being molded into the pre-mold material 220, the over-mold groove 222 and/or the wiggle ring groove 224 may be created by any method suitable to the desired end purpose, such as for example by partially removing pre-mold material 220 to form the over-mold groove 222 and/or the wiggle ring groove 224.

Referring to FIG. 5*a*, FIG. 5*b*, FIG. 5*c*, FIG. 5*d* and FIG. 5*e*, a wiggle ring 226 is shown and includes a wiggle ring structure 228 having a ring inner surface 230, a ring outer surface 232, a wiggle ring first end 234 and a wiggle ring second end 236, wherein the wiggle ring structure 228 includes a wiggle ring width W such that the wiggle ring structure 228 is substantially cylindrical in shape. The wiggle ring 226 further includes at least one wiggle ring groove interface 238 and a wiggle ring diameter D that is sized to fit over the pre-mold material 220. The at least one wiggle ring groove interface 238 includes a wiggle ring groove interface width X and is shaped, sized and positioned such that when the wiggle ring 226 is located over the pre-mold material 220, the at least one wiggle ring groove interface 238 is located within the wiggle ring groove 224 and the rest of the wiggle ring 226 substantially covers the pre-mold material 220 up to the connector neck 209. It is should be appreciated that the wiggle ring groove 224 includes a groove width Y which, if desired, may be equal to or larger than the wiggle ring groove interface width Y to allow the wiggle ring 226 to have a little movement if desired. It should be further appreciated that although the wiggle ring 226 and/or wiggle ring groove interface 238 is preferably constructed from polypropylene, the wiggle ring 226 may be constructed from any type of material suitable to the desired end purpose, such as such as plastic, rubber, composite, metal or any combination thereof. It should be appreciated that the at least one wiggle ring groove interface 238 may be contained within the wiggle ring groove 224 via any method suitable to the desired end purpose, such as a snap (friction) fit within wiggle ring groove 224 and/or an adhesive.

Figure 6A:
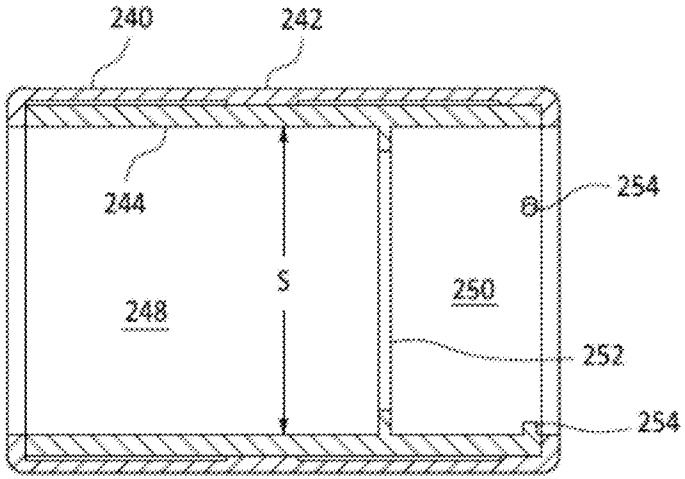
FIG. 6*a* is a side sectional view of a spin ring for the improved electrical connector assembly of FIG. 2.
Figure 6D:
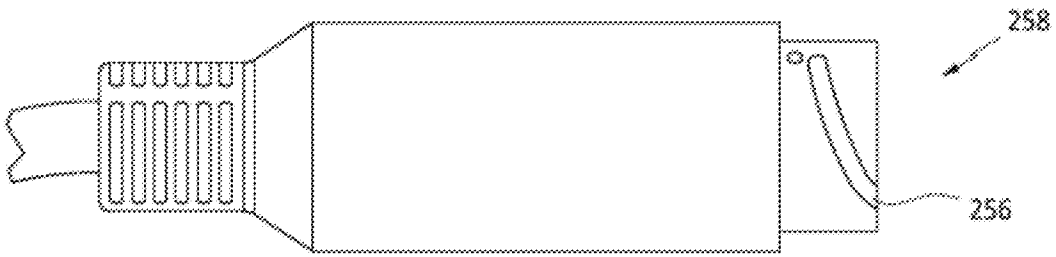
FIG. 6*d* is an isometric view of a connector configured to connect with the spin ring of FIG. 6*a*.
Figure 6C:
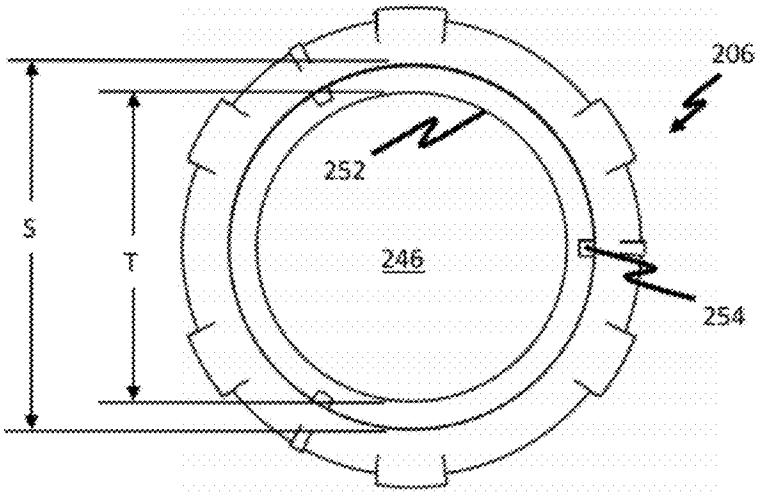
FIG. 6*c* is a front view of the spin ring of FIG. 6*a*.
Figure 6B:
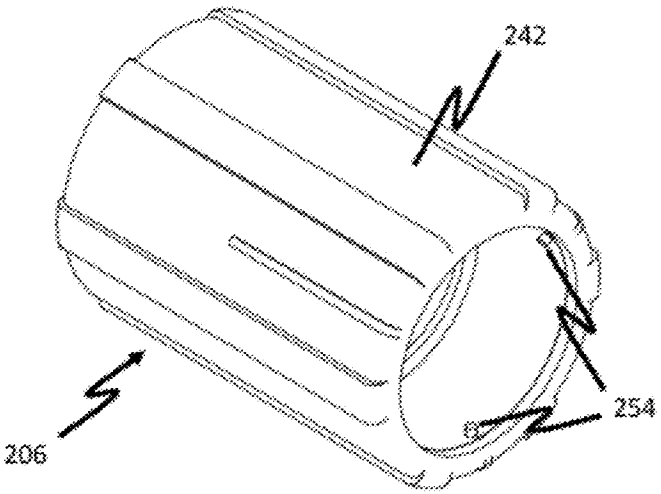
FIG. 6*b* is an isometric view of the spin ring of FIG. 6*a*.

Referring to FIG. 6*a*, FIG. 6*b* and FIG. 6*c*, the spin ring 206 is shown and includes a spin ring structure 240 having a spin ring outer surface 242, a spin ring inner surface 244 and defining a spin ring cavity 246. The spin ring inner surface 246 includes a first inner structure 248 and a second inner structure 250 separated by a spin ring neck 252, wherein the first inner structure 248, the second inner structure 250 and the spin ring neck 252 run the circumference of the spin ring inner surface 246. In accordance with the invention, the first inner structure 248 and second inner structure 250 have an inner structure diameter S and the spin ring neck 252 has a spin ring neck diameter T, where the spin ring neck diameter T is smaller than the inner structure diameter S. Moreover, the second inner structure 250 includes a plurality of protrusions 254 located at the end of the second inner structure 250 opposite the spin ring neck 252. It should be appreciated that, as discussed further hereinafter, the spin ring neck diameter T may be less than the housing neck diameter A. It should be appreciated that when being associated with an associated connector 258 the protrusions 254 may also act to engage with a groove 256 of the associated connector 258 (See FIG. 6*d*) to securely associate the electrical connector assembly 200 with the associated connector 258. Although the first inner structure 248 and second inner structure 250 is discussed herein as being aluminum, it is contemplated that the first inner structure 248 and/or second inner structure 250 may be constructed from any type of material suitable to the desired end purpose, such as plastic, rubber, composite, metal or any combination thereof. Moreover, although the spin ring outer surface 242 is preferably constructed from a thermoplastic (TPR) material, the spin ring outer surface 242 may be constructed from any type of material suitable to the desired end purpose, such as such as plastic, rubber, composite, metal or any combination thereof.

Figure 7:
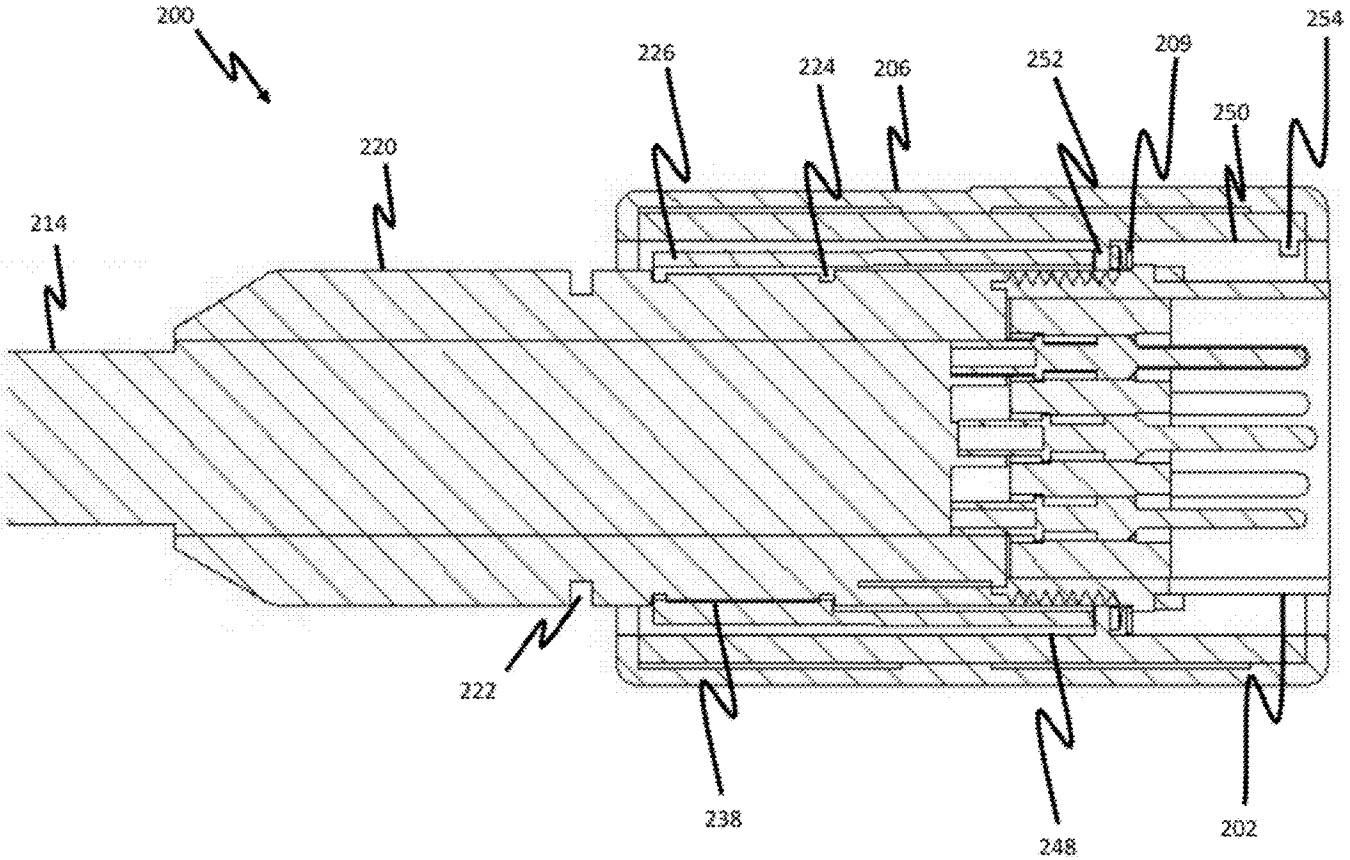
FIG. 7 is a side sectional view of the improved electrical connector assembly of FIG. 2, without the over-mold material.

Referring to FIG. 7, a side sectional view of the improved electrical connector assembly 200 following the application of the pre-mold material 220, but prior to the application of the over-mold material 204 is shown. As can be seen, the wiggle ring 226 is shown located over the pre-mold 220 such that the wiggle ring groove interface 238 is located within the wiggle ring groove 224 and the rest of the wiggle ring 226 substantially covers the pre-mold material 220 up to the connector neck 209. The wiggle ring 226 may be associated with the pre-mold material 220 by sliding the wiggle ring 226 along the cable 214 such until the wiggle ring groove interface 238 is located within the wiggle ring groove 224, where the wiggle ring groove interface 238 and the wiggle ring groove 224 engage each other to inhibit substantial movement along the axial direction of the electrical connector 202. The spin ring 206 is shown located over the improved electrical connector assembly 200 to cover the electrical connector 202 and the wiggle ring 226.

It should be appreciated that the spin ring 206 may be associated with the improved electrical connector assembly 200 by sliding the spin ring 206 along the cable 214 until protrusions 254 located on the second inner structure 250 make contact with the housing neck 209 of the electrical connector 202. The spin ring 206 may then be angled slightly and moved in the axial direction of the electrical connector 202 such that the protrusions 254 are located on the side of the housing neck 209 that is not proximate the wiggle ring 226 and the spin ring 206 is covering the electrical connector 202 and the wiggle ring 226. As such, the housing neck 209 is located between the spin ring neck 252 and the protrusions 254 and because the spin ring neck diameter T is less than or equal to and the housing neck diameter A, the spin ring 206 is inhibited from coming off of the end of the improved electrical connector assembly 200.

Figure 8:
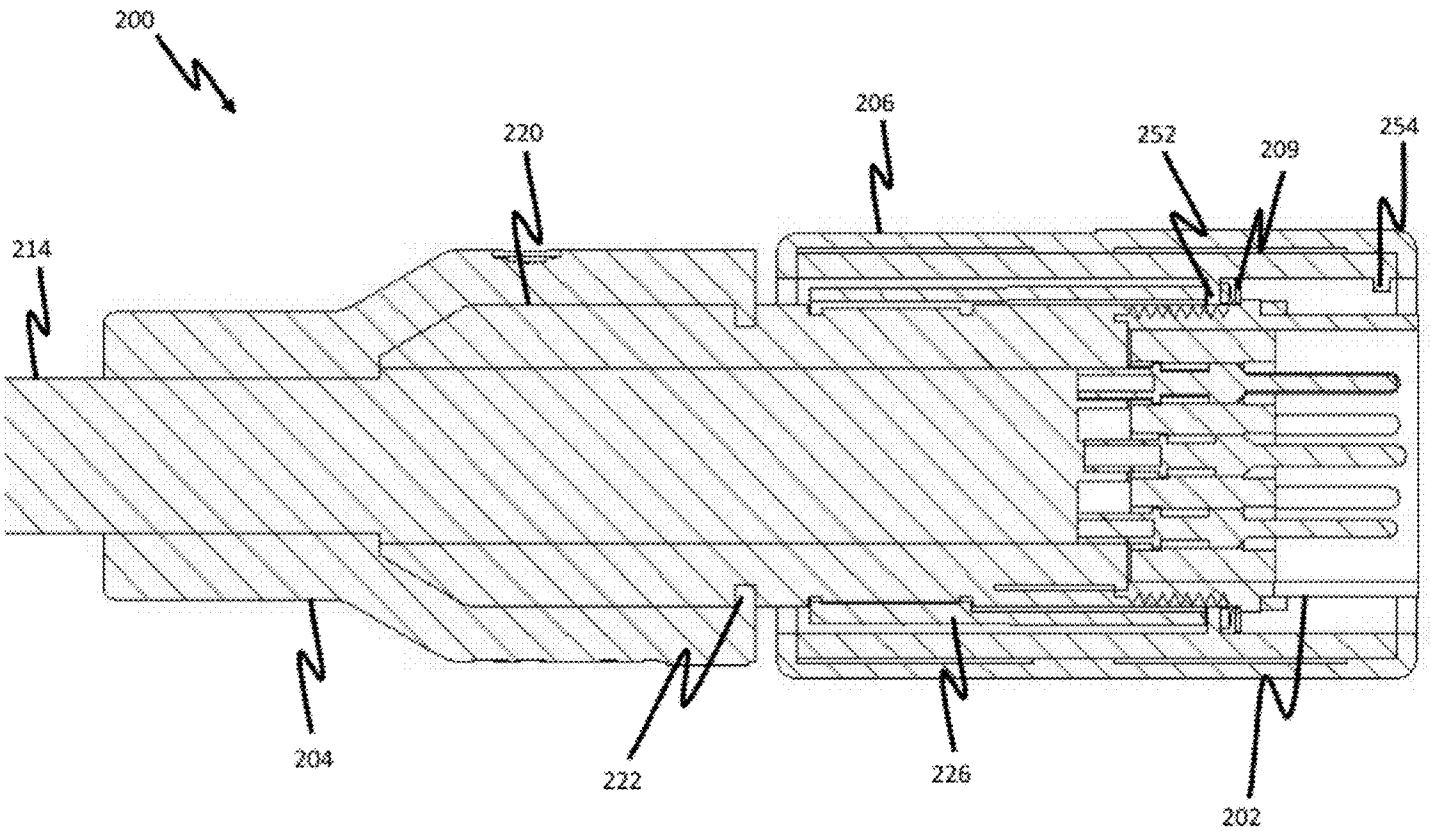
FIG. 8 is a side sectional view of the improved electrical connector assembly of FIG. 2.

Referring to FIG. 8, a side sectional view of the improved electrical connector assembly 200 following the application of the over-mold material 204, where the over-mold material 204 is associated with the improved electrical connector assembly 200 such that the over-mold material 204 covers a portion of the cable 214 and a portion of the pre-mold material 220. It should be appreciated that one end of the over-mold material 204 terminates proximate the spin ring 206 such that the over-mold material 204 is located within the over-mold groove 222. This over-mold groove 222 provides an 'anchor' point for the over-mold material 204 and eliminates a peel point. The presence of the over-mold material 204 may inhibit the spin ring 206 from sliding off of the rear end of the improved electrical connector assembly 200 toward the cable 214 if the wiggle ring 226 ever failed. It should be appreciated that the improved electrical connector assembly 200 of the present invention is superior to currently existing electrical connectors because the combination of the pre-mold material 220 and the over-mold material 204 provides better support to the connections between the electrical conductors 216 and the connector pins 210, thus providing better strain protection. Additionally, the spin ring 206 allows for a more secure connection between the improved electrical connector assembly 200 and a mating connector. The addition of the wiggle ring 226 not only provides better support to the spin ring 206 by inhibiting (and/or limiting) axial, angular and/or side-to-side motion of the spin ring 206, it improves performance by allowing for the connectors to be more easily associated and disassociated with/from other connectors as well as providing a more pleasing and rigid tactile feel. It should be appreciated that the wiggle ring 226 may be sized to be thinner or wider than that disclosed herein (for example to cover more area of the wiggle ring groove 224). Additionally, one or more wiggle rings 226 may be used as desired.

Figure 9:
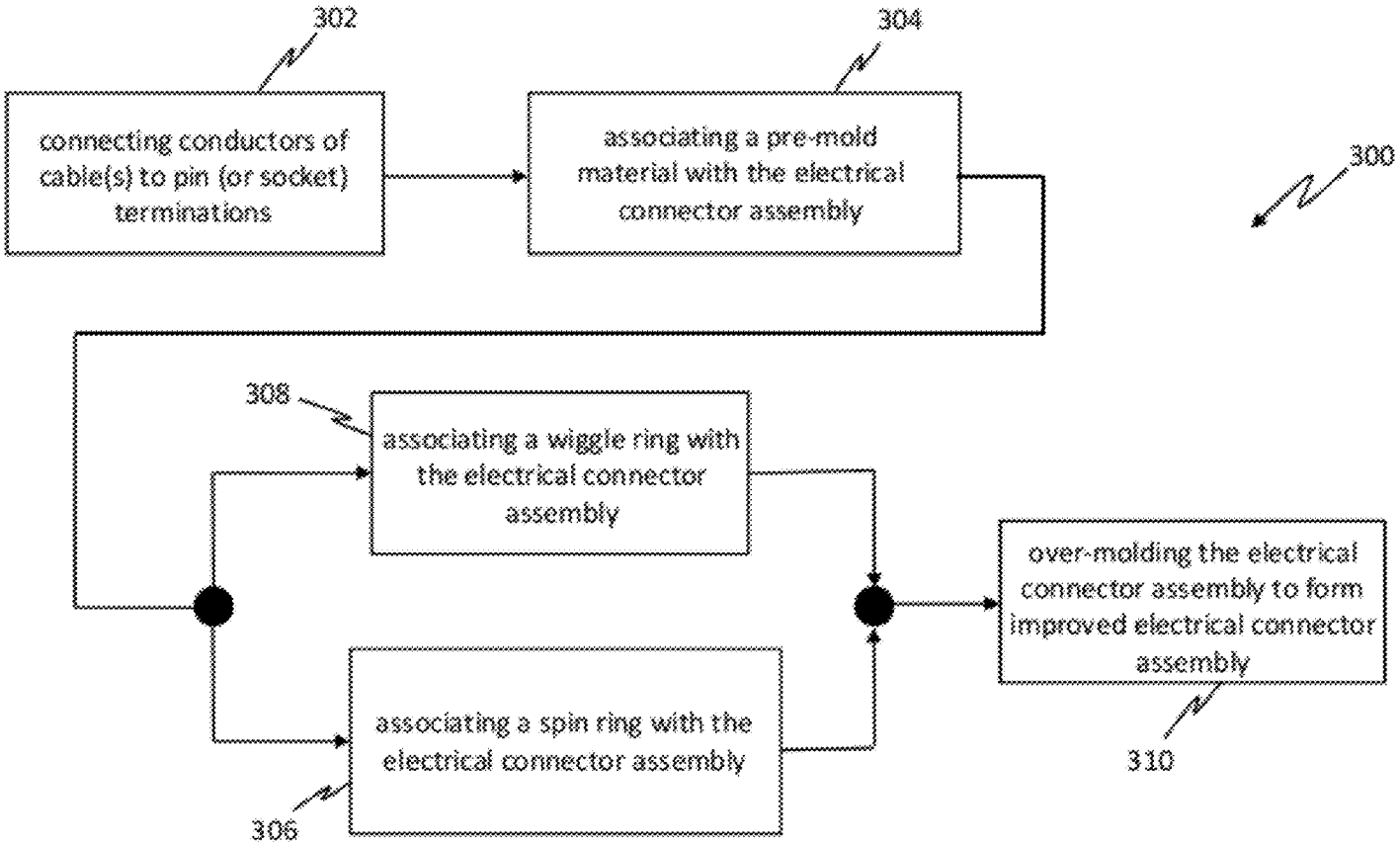
FIG. 9 is an operational block diagram illustrating one embodiment of a method for making the improved electrical connector assembly of FIG. 2.

Referring again to FIG. 2, an improved electrical connector assembly 200 is shown in accordance with the present invention, where the improved electrical connector assembly 200 includes a pre-mold material 226, an over-mold material 204 and a spin ring 206 which results in a better supported and more secure connection between associated electrical connectors, thus providing for better strain protection and a more desirable tactile feel. Referring to FIG. 9, an operational block diagram illustrating one embodiment of a method 300 for making the improved electrical connector assembly 200 is shown and includes connecting the plurality of electrical conductors 216 to at least one of the plurality of pin (or socket) terminations 210 of an electrical connector 202 to form a partial connector assembly 200 (See FIG. 3), as shown in operational block 302. The partial connector assembly 200 includes the cable 214 and the multi-pin (or socket) connector 202. A pre-molded electrical connector assembly 200 (See FIG. 4) is created by associating a pre-mold material 220 with the partial connector assembly 200, as shown in operational block 304. This may be accomplished by associated the pre-mold material 220 such that the pre-mold material 220 covers the physical connections of the electrical conductors 216 of the cable 214 and the pin (or socket) terminations 210, as well as a portion of the cable 214 and a portion of the electrical connector 202 (up to the connector neck 209).

Referring to FIG. 5*a*-5*e*, the wiggle ring 226 is associated with the electrical connector assembly 200, as shown in operational block 306. This may be accomplished by moving the wiggle ring 226 along the cable 214 toward the electrical connector 202 such that the wiggle ring groove interface 238 is associated with the wiggle ring groove 224. Referring to FIG. 6*a*-*d* and FIG. 7, the spin ring is associated with the electrical connector assembly 200, as shown in operational block 308. This may be accomplished by moving the spin ring 206 along the cable 214 toward the electrical connector 202 until protrusions 254 located on the second inner structure 250 make contact (or are located proximate) with the housing neck 209 of the electrical connector 202. The spin ring 206 may then be angled slightly and moved in the axial direction of the electrical connector 202 such that the protrusions 254 are located on the side of the housing neck 209 that is not proximate the wiggle ring 226 and the spin ring 206 is covering the electrical connector 202 and the wiggle ring 226. At this point, the housing neck 209 is located between the spin ring neck 252 and the protrusions 254. It should be appreciated that operational block 306 and operational block 308 may be implemented in any order as desired. For example, the spin ring 206 may be associated with the electrical connector assembly 200 and then the wiggle ring 226 may be associated with the electrical connector assembly 200 or the wiggle ring 226 may be associated with the electrical connector assembly 200 and then the spin ring 206 may be associated with the electrical connector assembly 200.

Referring to FIG. 8, the over-mold material 204 is then associated with the electrical connector assembly 200, as shown in operational block 310. This may be accomplished by associated the over-mold material 204 with the electrical connector assembly 200 to cover a portion of the cable 214 and a portion of the pre-mold material 220, such that one end of the over-mold material 204 terminates proximate the spin ring 206 where the over-mold material 204 is located within the over-mold groove 222. It should be appreciated that the spin ring/wiggle ring combination may also be implemented in connectors that do not use a pre-mold and/or an over-mold material.

Figure 10:
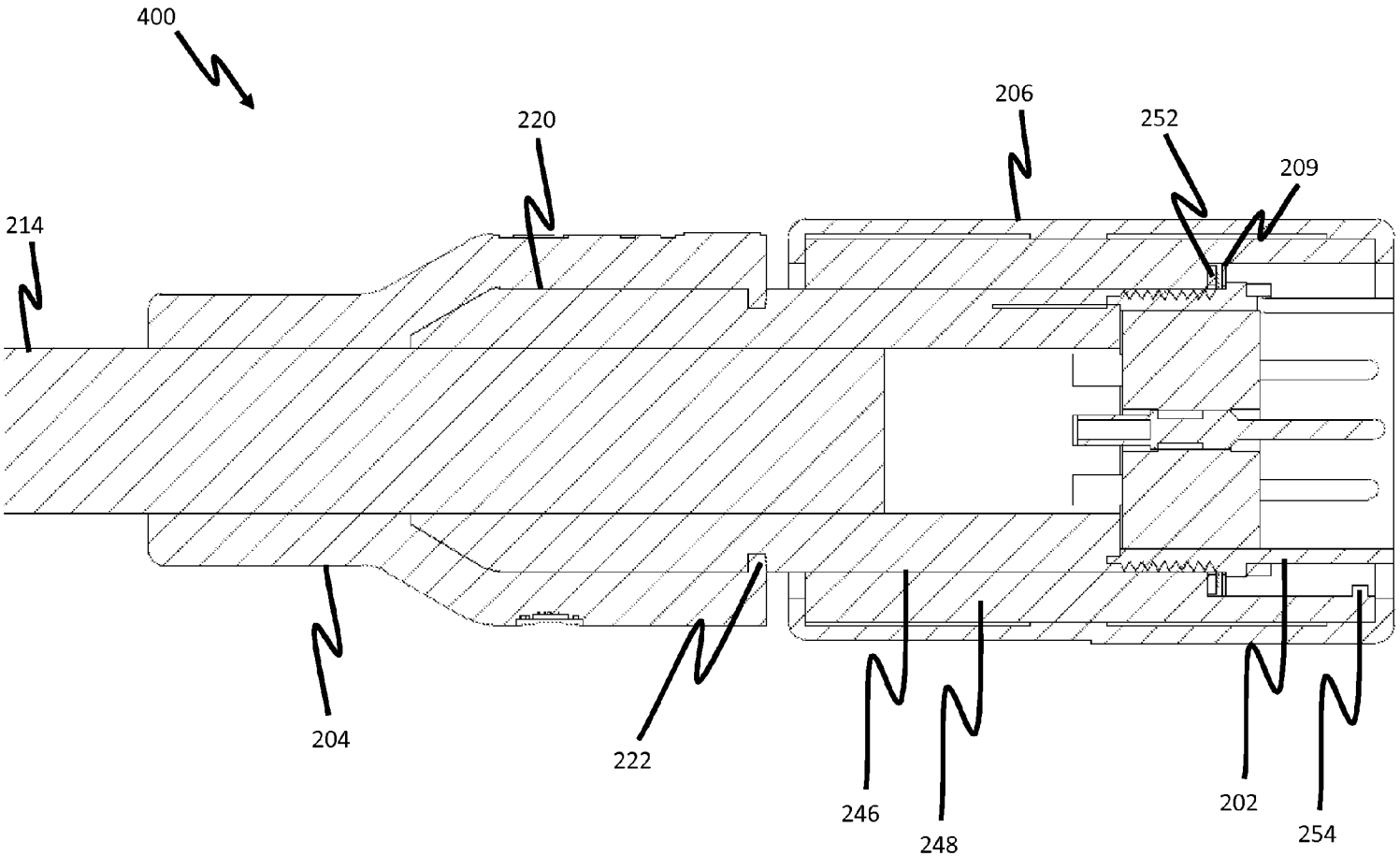
FIG. 10 is a side sectional view of another embodiment of an improved electrical connector assembly, in accordance with the present invention.

Referring to FIG. 10, another embodiment of an improved electrical connector assembly 400 is shown, where the wiggle ring 226 is replaced by increasing the size of at least a portion of the first inner structure 248 of the spin ring inner surface 246, such that the inner structure diameter S in the area of the first inner structure 248 is decreased. Accordingly, the first inner structure 248 of the spin ring inner surface 246 is sized to be adjacent the surface of the pre-mold material 220 (and/or the wiggle ring groove 224). This would effectively act to inhibit (and/or reduce) angular and/or side-to-side motion of the spin ring 206 in the same manner as the wiggle ring 224.

Figure 11:
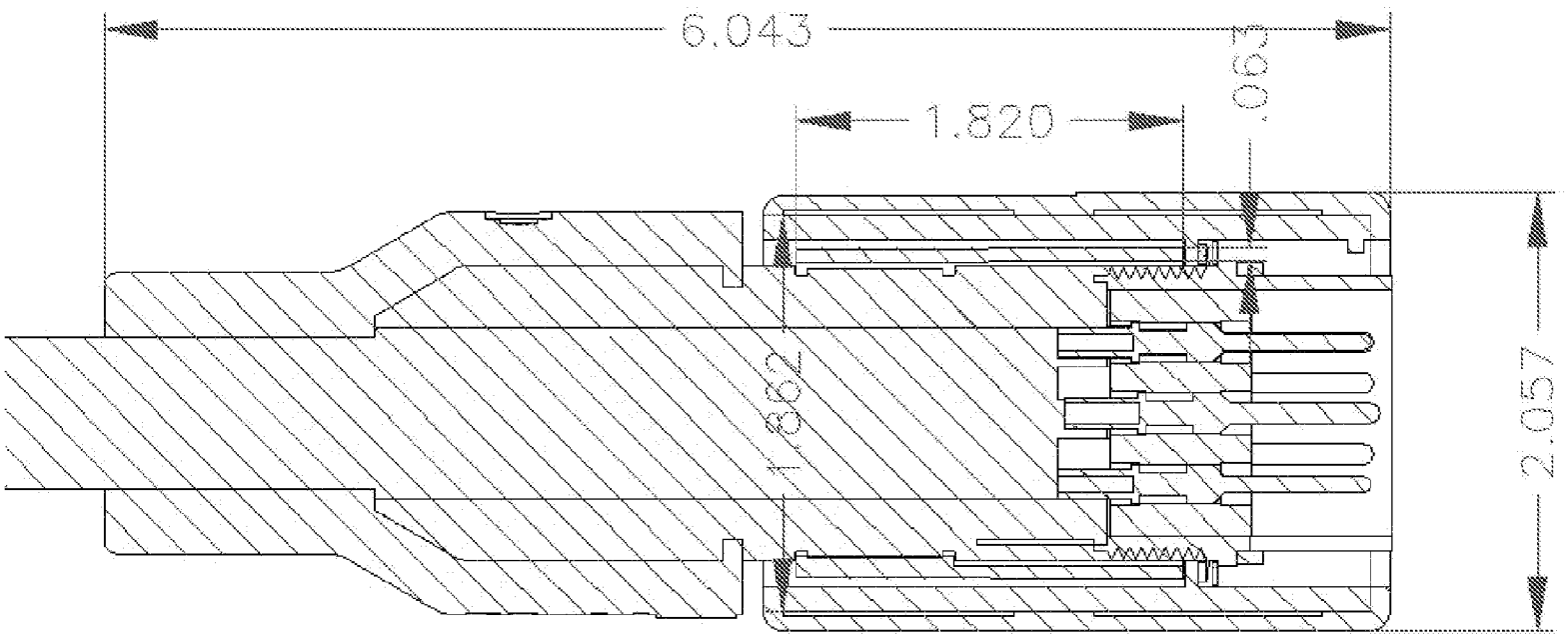
FIG. 11 is a side sectional view of the improved electrical connector assembly of FIG. 2, showing the dimensions of one embodiment.

It should be appreciated that the improved electrical connector assembly 200, 400 may constructed of any size suitable to the desired end purpose. Accordingly, the electrical connector assembly 200, 400 is not limited in size and the improved electrical connector assembly 200, 400 and/or it elements (i.e. the electrical connector, pre-mold material, over-mold material, wiggle ring, spin ring, etc. . . . ) may be sized to suit its specific and/or general purpose. For example, FIG. 11 illustrates one such embodiment of the improved electrical connector assembly having dimensions displayed in inches.

It should be appreciated that although the pre-mold and over-mold material is discussed herein with regards to being a thermoplastic elastomer (TPE) material, such as Santoprene® or some other synthetic rubber/polypropylene combination, it is contemplated that any material suitable to the desired end purpose may be used, such as a material that has an ergonomic, electrically insulating and/or structurally supporting property.

It should be further appreciated that for simplicity the term cable is used herein to refer to optical fibers, single conductors (wires) and/or cable assemblies having multiple conductors or optical fibers. Accordingly, the mold, method and electrical connector assembly disclosed herein in accordance with the invention may include 1) single and/or multiple wire conductor(s), 2) single or multiple optical fiber(s), 3) multiple cable assembly(s), where each assembly may be constructed from single and/or multiple conductors and/or optical fibers, and/or 4) any combination of the above.

In accordance with the present invention, the processing of the method 300 in FIG. 9 may be implemented, wholly or partially, by a controller operating in response to a machine-readable computer program. In order to perform the prescribed functions and desired processing, as well as the computations therefore (e.g. execution control algorithm(s), the control processes prescribed herein, and the like), the controller may include, but not be limited to, a processor(s), computer(s), memory, storage, register(s), timing, interrupt (s), communication interface(s), and input/output signal interface(s), as well as combination comprising at least one of the foregoing.

Moreover, the method of the present invention may be embodied in the form of a computer or controller implemented processes. The method of the invention may also be embodied in the form of computer program code containing instructions embodied in tangible media, such as floppy diskettes, CD-ROMs, hard drives, and/or any other computer-readable medium, wherein when the computer program code is loaded into and executed by a computer or controller, the computer or controller becomes an apparatus for practicing the invention. The invention can also be embodied in the form of computer program code, for example, whether stored in a storage medium, loaded into and/or executed by a computer or controller, or transmitted over some transmission medium, such as over electrical wiring or cabling, through fiber optics, or via electromagnetic radiation, wherein when the computer program code is loaded into and executed by a computer or a controller, the computer or controller becomes an apparatus for practicing the invention. When implemented on a general-purpose microprocessor the computer program code segments may configure the microprocessor to create specific logic circuits.

It should be appreciated that while the invention has been described with reference to an exemplary embodiment, it will be understood by those skilled in the art that various changes, omissions and/or additions may be made and equivalents may be substituted for elements thereof without departing from the spirit and scope of the invention. In addition, many modifications may be made to adapt a particular situation or material to the teachings of the invention without departing from the scope thereof. Therefore, it is intended that the invention not be limited to the particular embodiment disclosed as the best mode contemplated for carrying out this invention, but that the invention will include all embodiments falling within the scope of the appended claims. Moreover, unless specifically stated any use of the terms first, second, etc. do not denote any order or importance, but rather the terms first, second, etc. are used to distinguish one element from another.

What is claimed is:

1. An electrical connector assembly, comprising:

a cable having an electrical conductor;

an electrical connector having an electrical connector neck which separates an electrical connector rear from an electrical connector front, wherein the electrical connector neck includes an electrical connector neck diameter and the electrical connector rear includes an electrical connector termination connected to the electrical conductor, a pre-mold material having an over-mold groove and a wiggle ring groove, the pre-mold material being securely associated with the electrical connector assembly to cover the electrical connector rear, the electrical connector termination, and a portion of the electrical conductor and the cable; and an over-mold material securely associated with the electrical connector assembly to cover a portion of the pre-mold material and the cable, wherein a portion of the over-mold material is located in the over-mold groove.

2. The electrical connector assembly of claim 1, further comprising a spin ring having a spin ring front, a spin ring rear and a spin ring inner surface which defines a spin ring cavity having a spin ring cavity diameter, wherein the spin ring is movably associated with the electrical connector assembly such that the spin ring rear is located proximate the over-mold material and such that the spin ring covers the electrical connector front and the electrical connector rear.

3. The electrical connector assembly of claim 2, wherein the spin ring further includes a plurality of protrusions and a spin ring neck, wherein the plurality of protrusions are located proximate the spin ring front and wherein the spin ring neck is located within the spin ring cavity and includes a spin ring neck diameter.

4. The electrical connector assembly of claim 3, wherein the spin ring is movably associated with the electrical connector assembly such that the plurality of protrusions are located on one side of the electrical connector neck to be proximate the electrical connector front and the spin ring neck is located on the opposing side of the electrical connector neck to be proximate the electrical connector rear.

5. The electrical connector assembly of claim 3, wherein at least one of, the spin ring inner surface is sized to be adjacent the surface of the pre-mold material to limit angular movement of the spin ring relative to the pre-mold material, and the spin ring neck diameter is smaller than the electrical connector neck diameter.

6. The electrical connector assembly of claim 1, further comprising a wiggle ring, wherein when the wiggle ring is associated with the electrical connector assembly, the wiggle ring covers at least a portion of the pre-mold material between the over-mold groove and the electrical connector neck.

7. The electrical connector assembly of claim 6, wherein the wiggle ring includes a wiggle ring thickness sized to fit between the pre-mold material and the spin ring inner surface to limit angular movement of the spin ring.

8. The electrical connector assembly of claim 6, wherein the wiggle ring includes a wiggle ring groove interface and the pre-mold material includes a wiggle ring groove, wherein when the wiggle ring is associated with the electrical connector assembly, the wiggle ring groove interface is located within the wiggle ring groove to inhibit movement of the wiggle ring.

9. An electrical connector, comprising:

an electrical connector having an electrical connector neck which separates an electrical connector rear from an electrical connector front, wherein the electrical connector rear includes an electrical connector termination;

a pre-mold material having an over-mold groove and a wiggle ring groove, the pre-mold material being securely associated with the electrical connector to cover the electrical connector rear and the electrical connector termination; and an over-mold material securely associated with the electrical connector to cover a portion of the pre-mold material, wherein a portion of the over-mold material is located in the over-mold groove.

10. The electrical connector, of claim 9, further comprising a cable having an electrical conductor connected to the electrical connector termination, wherein the pre-mold material covers a portion of the electrical conductor and the cable.

11. The electrical connector of claim 9, further comprising a spin ring having a spin ring front, a spin ring rear and a spin ring inner surface which defines a spin ring cavity having a spin ring cavity diameter, wherein the spin ring is movably associated with the electrical connector such that the spin ring rear is located proximate the over-mold material and such that the spin ring covers the electrical connector front and the electrical connector rear.

12. The electrical connector of claim 11, wherein the spin ring further includes a plurality of protrusions and a spin ring neck, wherein the plurality of protrusions are located proximate the spin ring front and wherein the spin ring neck is located within the spin ring cavity and includes a spin ring neck diameter.

13. The electrical connector of claim 12, wherein the spin ring is movably associated with the electrical connector such that the plurality of protrusions are located on one side of the electrical connector neck to be proximate the electrical connector front and the spin ring neck is located on the opposing side of the electrical connector neck to be proximate the electrical connector rear.

14. The electrical connector of claim 12, wherein the electrical connector neck includes an electrical connector neck diameter and wherein the electrical connector further includes at least one of, the spin ring inner surface is sized to be adjacent the surface of the pre-mold material to limit angular movement of the spin ring relative to the pre-mold material, and the spin ring neck diameter is smaller than the electrical connector neck diameter.

15. The electrical connector assembly of claim 9, further comprising a wiggle ring, wherein when the wiggle ring is associated with the electrical connector, the wiggle ring covers at least a portion of the pre-mold material between the over-mold groove and the electrical connector neck.

16. The electrical connector assembly of claim 15, wherein the wiggle ring includes a wiggle ring thickness sized to fit between the pre-mold material and the spin ring inner surface to limit angular movement of the spin ring.

17. The electrical connector assembly of claim 15, wherein the wiggle ring includes a wiggle ring groove interface and the pre-mold material includes a wiggle ring groove, wherein when the wiggle ring is associated with the electrical connector, the wiggle ring groove interface is located within the wiggle ring groove to inhibit movement of the wiggle ring.

* * * * *